United States Patent [19]

Hystad

[11] Patent Number: 4,458,631

[45] Date of Patent: Jul. 10, 1984

[54] STOP ASSEMBLY FOR SECURING A BUOY LINE CONNECTING A MOORING ANCHOR TO THE ASSOCIATED BUOY

[75] Inventor: Per H. Hystad, Kopervik, Norway

[73] Assignee: Karmoy Mek. Versted A.S., Kopervik, Norway

[21] Appl. No.: 331,021

[22] Filed: Dec. 15, 1981

[30] Foreign Application Priority Data

Dec. 18, 1980 [NO] Norway ..... 803852

[51] Int. Cl.[3] ..... B63B 21/01

[52] U.S. Cl. ..... 114/199; 114/218; 254/389

[58] Field of Search ..... 114/199, 200, 210, 293, 114/294, 218; 410/107, 111–114, 116; 254/389, 391, 407

[56] References Cited

U.S. PATENT DOCUMENTS

| | | | |
|---|---|---|---|
| 3,507,243 | 4/1970 | Brown | 114/218 |
| 3,892,386 | 7/1975 | Hogan | 114/254 |
| 4,348,975 | 9/1982 | Dove | 114/210 |

*Primary Examiner*—Sherman D. Basinger

*Attorney, Agent, or Firm*—Finnegan, Henderson, Farabow, Garrett & Dunner

[57] ABSTRACT

A stop assembly on a vessel for securing a buoy line connecting a mooring anchor and an associated buoy, comprising at least one fork-shaped stop member which is mounted so as to be raised up from and lowered down into the deck of a ship and which can be remote-controlled from a command location, the opening between the arms of the fork being wide enough to provide room for the buoy line, but narrow enough that an expansion on the line, for example, a swage sleeve, rope wire thimble or the like will be restrained so that the line is securely locked in position.

3 Claims, 4 Drawing Figures

STOP ASSEMBLY FOR SECURING A BUOY LINE CONNECTING A MOORING ANCHOR TO THE ASSOCIATED BUOY

BACKGROUND OF THE INVENTION

The present invention relates to a stop assembly for securing a buoy line connecting a mooring anchor to an associated buoy when at least a part of the line has been winched on board an oceangoing vessel.

In the drilling or production of oil and gas offshore, the drilling platforms are moored fast to the sea bed with large anchors. From time to time it is necessary to move these anchors, which is done by hoisting them on board a supply ship, for instance. The connection to the anchor is provided via a buoy floating on the surface of the water which is connected to the anchor by a buoy line. A wire rope from the winch on board the ship is connected to the buoy and the buoy can then be hoisted on board the vessel. Owing to the size of the buoy—it may be several meters in diameter with a height greater than the diameter—the buoy must be released from the buoy line and the winch cable and the latter two lines have to be coupled together before the actual raising of the anchor can begin. When the buoy has been hoisted on board the deck of the vessel, the buoy line to the anchor will be very tautly stretched, and various types of large and heavy stop means and associated fastening wires have been utilized previously to secure the buoy line on board in such manner that one can use the winch to slacken both the winch cable and the part of the buoy line lying on deck enough to permit release of the buoy and connection of the buoy line to the winch cable, whereupon the anchor can then be lifted free of the sea bed and moved or brought on board the supply ship.

SUMMARY OF THE INVENTION

The forces which are operating under these conditions are great, and the work of attaching and removing the cable stop means which have been used heretofore requires time; moreover, since this work has to be performed in the vicinity of the buoy, there are elements of risk involved in this work should the buoy get out of control, in difficult weather conditions, for example. Several accidents in which people have been injured and killed have occured in this connection. It is therefore an object of the invention to arrive at an assembly which enables the buoy line connecting a mooring anchor to its associated buoy to be secured on deck without requiring the presence of crew members on deck until the buoy line and winch cable have been slackened off and the shackles can then be removed in a short time.

In accordance with the invention, this is achieved in that one or more stop means are movably mounted in the deck of the ship, enabling them to be held retracted below the plane of the deck when not in use so that they do not obstruct, e.g., the hoisting of the buoy onto the deck, or any other work being performed on deck. When the buoy line is to be secured on deck, the stop means is elevated in back of a wire rope thimble, a swage sleeve or some other expansion member on the buoy line, and the portions of the line lying interiorally of this obstruction on the line together with the winch cable can be slackened off, so that connection/disconnection can be performed without risk.

The invention is characterized by the features recited in the appurtenant patent claims, and will be discussed in greater detail in the following with reference to the accompanying drawings, wherein

DETAILED DESCRIPTION

Figure 1:
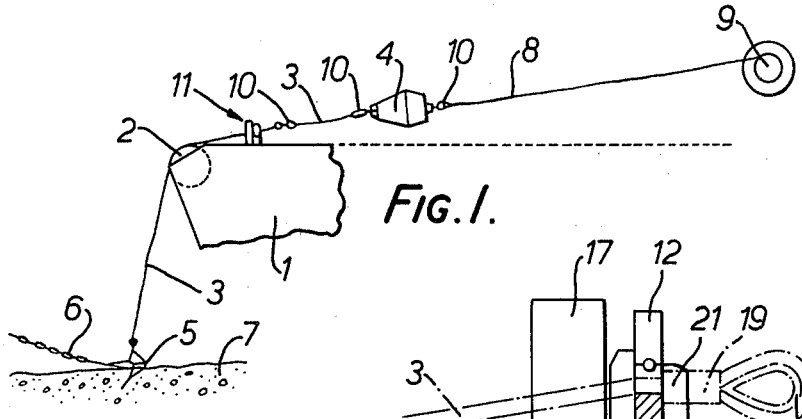
FIG. 1, in a highly simplified manner, illustrates how the raising of an anchor is performed.

A broken-away section of the stern 1 of a supply ship may be seen in FIG. 1. The stern has a roller 2 at the rail over which the buoy line 3 is pulled when the buoy 4 is being hauled in. The buoy line 3 is fastened to the anchor 5 and to the buoy 4, which normally floats on the water surface to mark the location of the anchor 5. The anchor 5 has a chain 6 which is connected to a drilling platform or some other equipment which is moored to the sea bed 7. When it is desired to move the anchor 5 or to raise it, the supply ship approaches the buoy 4 and fastens a winch cable 8 to the buoy, and the anchor can then be hauled in by means of a winch 9. When the buoy 4 has been pulled on board the ship, it has to be disconnected from the buoy line 3 and winch cable 8 before the anchor 5 can be raised further, release of the buoy 4 being obtained by opening shackles 10. This work, however, cannot be done if the line 3 and cable 8 are stretched taut; heretofore, stop means which are large and heavy, which must be attached manually to the buoy line 3, and which are connected to winches on deck, for example, have been used to hold fast the part of the buoy line 3 which is on board the ship so that one can slacken off the part of the buoy line 3 interior of the stop means and the cable 8 with the winch 9 enough to permit the shackles 10 to be opened and the buoy 4 released. Owing to the forces that are operative and because of the size of the buoy, which may be several meters in height and in diameter, it is risky even to be on deck when the buoy 4 is being hoisted on board. As mentioned previously, accidents and deaths have occurred in connection with this work.

Figure 2:
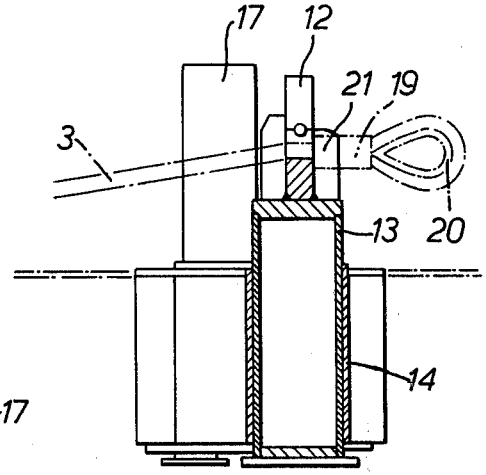
FIG. 2 shows a stop assembly in accordance with the invention, seen from the side and in partial cross section.
Figure 3:
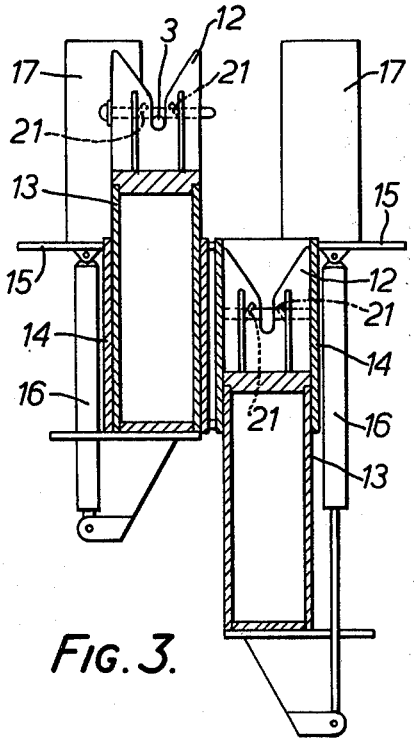
FIG. 3 shows the assembly of the invention in partial cross section, seen looking toward the stern of the vessel.
Figure 4:
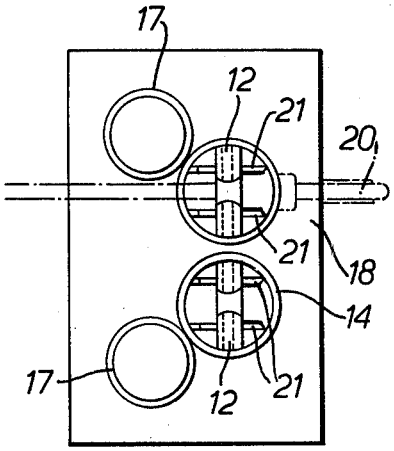
FIG. 4 shows the assembly of the invention as seen from above, with the various components assembled into a unit.

This problem, however, is solved with the present invention by means of a remote-controlled stop assembly indicated generally at 11 in FIG. 1 and shown in more detail in FIGS. 2, 3 and 4. The stop assembly may be a single stop means, but in the example illustrated two stop assemblies are utilized, disposed side by side in the transverse direction of the ship. Each stop has a fork-shaped member 12 which may best be seen in FIG. 2. In the embodiment illustrated, the fork-shaped member 12 is carried on a cylinder 13 which fits slidably down into a cylinder 14. The cylinders 14 for the respective stop means are permanently installed in the deck or in a unit which forms a rigid construction which will be described later.

The cylinders 13 with the fork-shaped members 12 can be raised and lowered in relation to the deck 15 by means of hydraulic cylinders 16 which can be operated from a remote command location, for example, the wheelhouse on the vessel. When not in use, both of the stop means 12,13,14 are retracted below the level of the deck to be out of the way. Astern of the stop means 12,13,14 there are so-called rope guide pins 17 which guide the winch cable as it runs out from the winch and aft, passing over the roll 2 at the stern rail and off the ship, as indicated in FIG. 1. The relative placement of the rope guide pins 17 and stop means 12, 13 may be seen in FIG. 4, which shows the components mounted in a rigid, box-shaped structure 18 which may be permanently mounted in an opening in the ship deck. The rope guide pins 17 can also be raised and lowered into the deck so that they are out of the way when not needed, which can be done using the same hydraulic equipment that is used to operate the stop means 12.

The sequence of operations when the buoy is being hauled in and the anchor raised is as follows: The winch cable 8 is attached to the buoy 4 while the latter is floating in the sea. The buoy line 3 which is connected to the anchor is always substantially longer than the water depth so that the buoy 4 can be pulled well in onto the deck of the supply ship without the anchor 5 losing hold. Depending on wind and weather and currents, when the buoy line 3 is brought on board it will lie on either the starboard or the port side of the roll 2 at the stern rail, and this is why sets of rope guide pins 17 and stop means 12 are provided. When the buoy has been brought on board, it is manoevered so that the buoy line 3 comes so close to the midships line that the buoy line will be lying between the guide pins 17 when the latter are elevated from their retracted position below deck level. The buoy line 3 (see FIGS. 2 and 4) will then in all probability be lying against either one or the other of the rope guide pins 17, and if not, a small correction under the maneouvering will ensure that one obtains contact against the pin as shown in FIG. 4. The buoy line 3 will then pass over a stop means 12, and when the stop means is operated, e.g., from the wheelhouse, the fork-shaped member is raised so that its arms enclose the buoy line 3, as shown in FIG. 3. Thereafter the winch wire 8 is eased off (see FIG. 1) with the winch 9 until a thickened portion on the buoy line 3, for example, a swage sleeve 19 for a wire rope thimble 20 abuts against one face of the fork-shaped member 12 on the stop assembly, as shown in FIG. 2. The buoy line 3 is thereby securely locked in place and supports the weight of the anchor 5 until the latter is released from the sea bed 7. A locking bolt 21 is inserted manually (see FIG. 3) to lie on top of the buoy line 3, providing an extra safeguard to prevent an unintentional release of the buoy line 3 from the stop means, for instance, owing to a sudden and unexpected movement of the vessel.

Now, by easing off somewhat on the winch 9, the tension in the part of the buoy line 3 which lies to the right (in-board) of the stop 11 at the stern 1 of the ship and the tension in the winch cable 8 can be relieved so that it is possible to disconnect the buoy 4 and connect the winch cable 8 to the buoy line 3, so that the buoy line 3 and anchor 5 can be hauled in further. In this connection, it should be noted that, in the interest of simplicity, the dimensions of the ship and the depth of the ocean bed are drawn very much out of scale in FIG. 1.

After the buoy 4 has been released and stowed in a safe place, hauling-in of the anchor can continue, and the rope guide pins and stop assemblies are retracted below deck level so that they are out of the way when the anchor 5 at last comes on board.

When an anchor is being let go and a buoy being set out, the above sequence of operations is reversed.

As soon as the buoy has been connected to the buoy line and the locking bolt 21 removed, the buoy is ready to go.

The stop means is constructed so that the buoy can be deployed by being released directly from the stop means even when there is a load on the buoy line. If the stop means is driven quickly down into its retracted position, the buoy line will slip free of the fork and the stop means will be protected below deck level before the buoy rushes out aft.

The embodiment illustrated and discussed herein is meant only to illustrate the invention, which also may comprise other embodiments, for example, an embodiment having only one stop assembly which cooperates with one or two rope guide pins.

Having described my invention, I claim:

1. A stop assembly on a vessel for momentarily holding a thickened portion of a buoy line connecting a mooring anchor to an associated buoy to permit the buoy to be disconnected from the line when the buoy is hauled up on the deck of the vessel comprising a pair of fork-shaped stop members mounted side-by-side on the deck of the vessel so that they can be raised up individually from the deck to an operable position and lowered down into the deck to an out-of-the-way position, power means for separately raising and lowering the stop members from a remote location, each of said stop members having a pair of spaced arms open at the top to receive a buoy line therebetween when the member is raised above the deck, a rope guide pin mounted on the deck adjacent to, and ahead of and outwardly from each stop member in the direction of the buoy line to guide the buoy line over its associated fork-shaped member, the opening between the arms of the fork-shaped stop members being sized to freely permit the buoy line to pass through but preventing the thickened portion on the line from passing therebetween.

2. The stop assembly of claim 1, including a cylindrical guide mounted in the deck and having an internal slidable part which carries the fork-shaped stop member.

3. The stop assembly of claim 1 wherein the rope guide pins are mounted to be raised up from and retracted into the deck.

* * * * *